US007552696B1

(12) United States Patent
DeFord

(10) Patent No.: US 7,552,696 B1
(45) Date of Patent: Jun. 30, 2009

(54) RESTORED AND/OR REINFORCED FLAG AND METHODS FOR PRODUCING THE SAME

(76) Inventor: Judy DeFord, 11418 Fowler Ave., Omaha, NE (US) 68164

( * ) Notice: Subject to any disclaimer, the term of this patent is extended or adjusted under 35 U.S.C. 154(b) by 68 days.

(21) Appl. No.: 11/879,372

(22) Filed: Jul. 16, 2007

(51) Int. Cl.
*G09F 17/00* (2006.01)

(52) U.S. Cl. ..... 116/173

(58) Field of Classification Search ..... 116/173, 116/174, 175; 40/604, 617
See application file for complete search history.

(56) References Cited

U.S. PATENT DOCUMENTS

| | | | | |
|---|---|---|---|---|
| 1,275,603 | A | 8/1918 | Rives | |
| 1,303,623 | A | 5/1919 | Wilson | |
| 1,372,508 | A | 3/1921 | Herbener | |
| 1,398,376 | A | 11/1921 | Herbener | |
| 1,854,012 | A * | 4/1932 | Ames | 116/173 |
| 5,522,165 | A * | 6/1996 | Molla | 40/604 |
| 6,322,657 | B1 * | 11/2001 | Pontuti et al. | 156/304.3 |
| 2006/0207494 | A1 * | 9/2006 | Paley et al. | 116/173 |

FOREIGN PATENT DOCUMENTS

| | | | |
|---|---|---|---|
| DE | 19626932 | A1 * | 1/1998 |
| EP | 798688 | A1 * | 10/1997 |
| ES | 2027501 | A6 * | 6/1992 |
| JP | 07319415 | A * | 12/1995 |
| JP | 2004205820 | A * | 7/2004 |
| JP | 2007072113 | A * | 3/2007 |
| RU | 2058456 | C1 * | 4/1996 |

* cited by examiner

*Primary Examiner*—R. A. Smith
(74) *Attorney, Agent, or Firm*—Suiter Swantz pc llo

(57) ABSTRACT

A restored and/or reinforced flag that is durable and does not distract from the appearance of the flag by attaching at least one separate corner patch and twill tape to the flag with thread.

20 Claims, 13 Drawing Sheets

RESTORED AND/OR REINFORCED FLAG AND METHODS FOR PRODUCING THE SAME

FIELD OF THE INVENTION

The present invention generally relates to the field of flag production and flag repair, and more particularly to a method for producing a more durable flag.

BACKGROUND OF THE INVENTION

Flags that are flown outside have short lives, especially large flags. The wind causes the flag to whip and snap. This stress along with other outdoor elements, such as rain, snow, and sun will cause the flag to tear and tatter. The tearing will continue in the wind until the end of the flag is rendered unsightly even though most of the flag remains unscathed. This tearing occurs quickly due to the flimsy construction of flags. Often times, a flag may only last a week before it needs to be replaced.

Therefore, it would be desirable to provide a method for producing a flag and for restoring a torn and/or tattered flag that makes the flag more durable for longer use.

SUMMARY OF THE INVENTION

Accordingly, the present invention is directed to a reinforced and/or restored flag and a method for reinforcing a flag and a method for restoring a tattered and/or torn flag to make a flag durable. The reinforced flag has been reinforced by the addition of at least one corner patch and by the addition of twill tape. The reinforced flag allows the flag to be flown outside in the same conditions for longer than a flag that has not been reinforced before tattering and tearing. The method for producing a reinforced flag includes forming a corner patch, placing twill tape on the hem line and on a portion of the inner edge, attaching the formed corner patch to flag, and attaching the twill tape to the flag. The method for restoring a torn and tattered flag comprises cutting off the torn and tattered area of the flag and utilizing the method for reinforcing a flag. The reinforced and/or restored flag is durable and does not distract from the appearance of the flag.

It is to be understood that both the foregoing general description and the following detailed description are exemplary and explanatory only and are not necessarily restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

Figure 1:
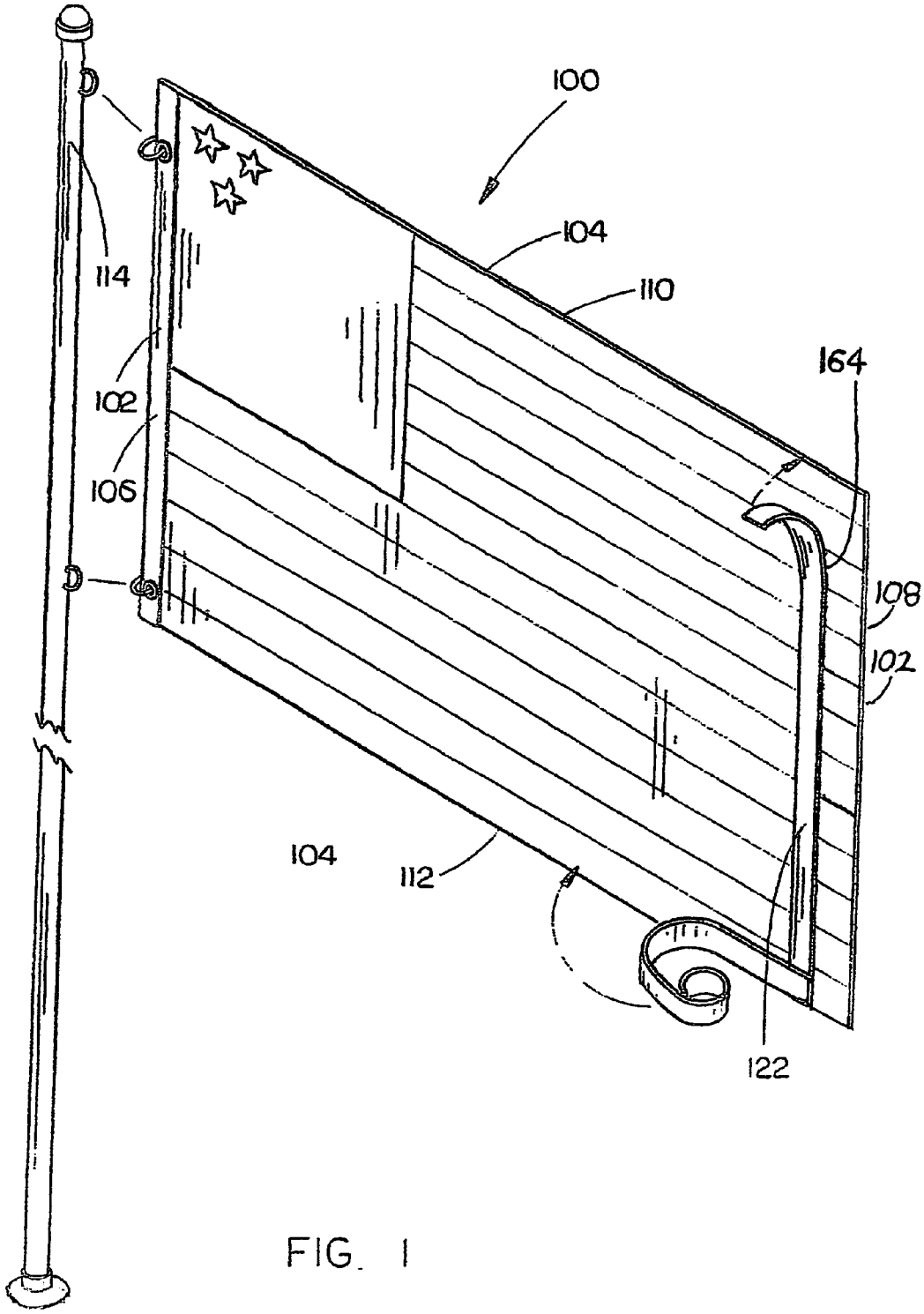
FIG. 1 is an isometric view illustrating flag restoration and/or flag reinforcement, in accordance with an exemplary embodiment of the present invention, wherein twill tape is placed on a portion of the bottom edge of a flag and across a hem line of the flag.

Typically, a flag comprises four edges and two sides. Referring to FIG. 1 a flag 100 is shown in accordance with exemplary embodiments of the present invention. The flag 100 has two outer edges 102 and two inner edges 104. The attachment edge 106 is the outer edge 102 of the flag 100 that attaches the flag 100 to a support device 114, such as a pole or rod. The exposed edge 108 is the outer edge 102 of the flag 100 found opposite the attachment edge 106. The top edge 110 is the inner edge 104 of the flag 100 that is farthest from the ground or floor when attached to a support device 114. The bottom edge 112 is the inner edge 104 of the flag 100 found closest to the ground or floor when attached to a support device 114. It is contemplated that a flag may have more or less edges without departing from the scope and intent of the present invention.

Figure 5:
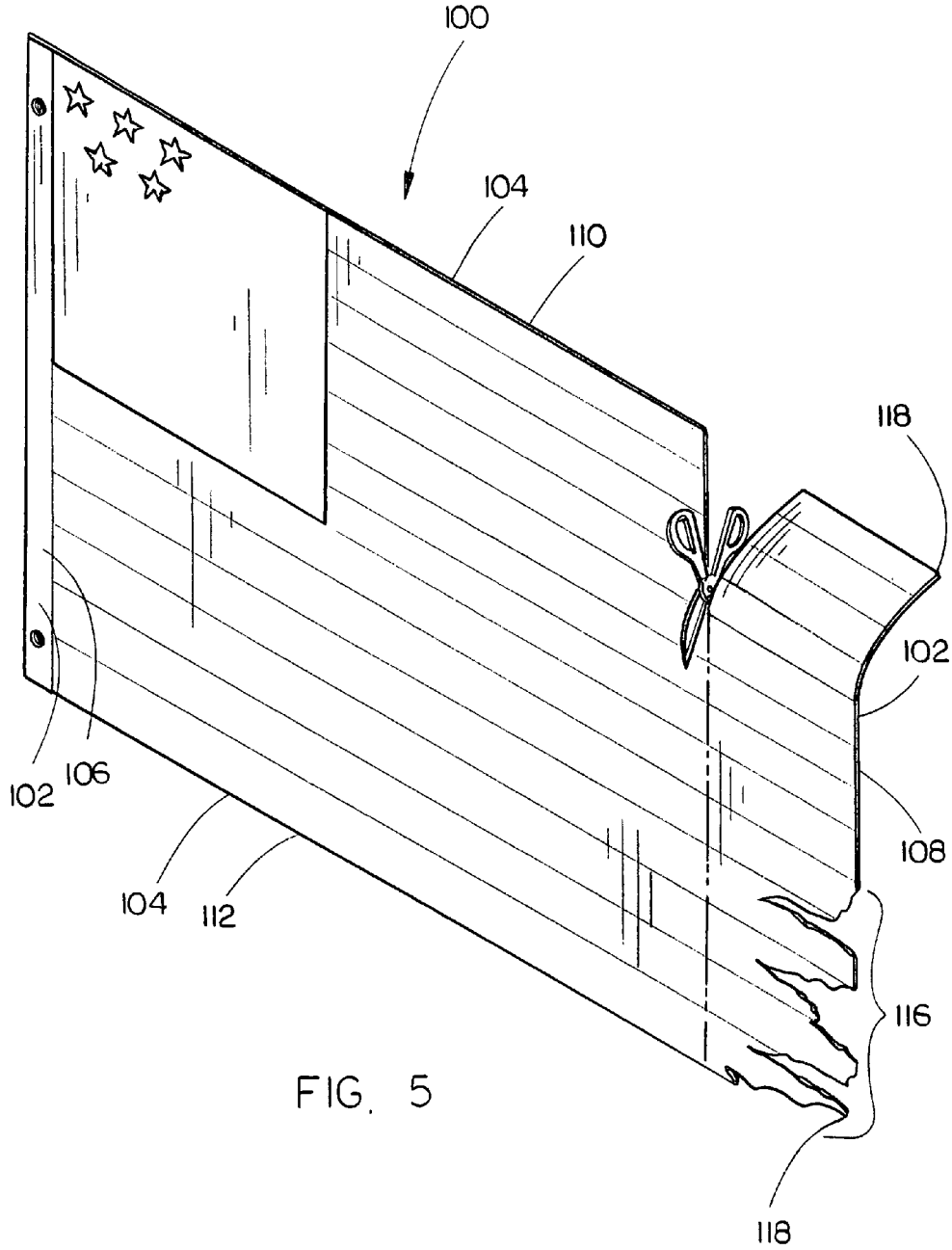
FIG. 5 is an isometric view illustrating flag restoration, in accordance with an exemplary embodiment of the present invention, wherein the torn and tattered portion of the flag is being removed.

Referring to FIG. 5, a flag 100 that has been torn or tattered 116 is shown in accordance with exemplary embodiments of the present invention. Flags 100 that are flown outside have short lives, especially large flags. The wind causes the flag to whip and snap. This stress along with other outdoor elements, such as rain, snow, and sun wilt cause the flag to tear and tatter. The tearing wilt continue in the wind until the end of the flag is rendered unsightly even though most of the flag remains unscathed. This tearing occurs quickly due to the flimsy construction of flags. Often times, a flag may only last a week before it needs to be replaced. Typically, the tattering or the tearing of the flag occurs at the corners adjacent to the exposed edge 118. The tearing and tattering happens at these exposed corners 118 because the stress of the whipping and snapping is felt the most at the exposed corners 118.

Figure 2:
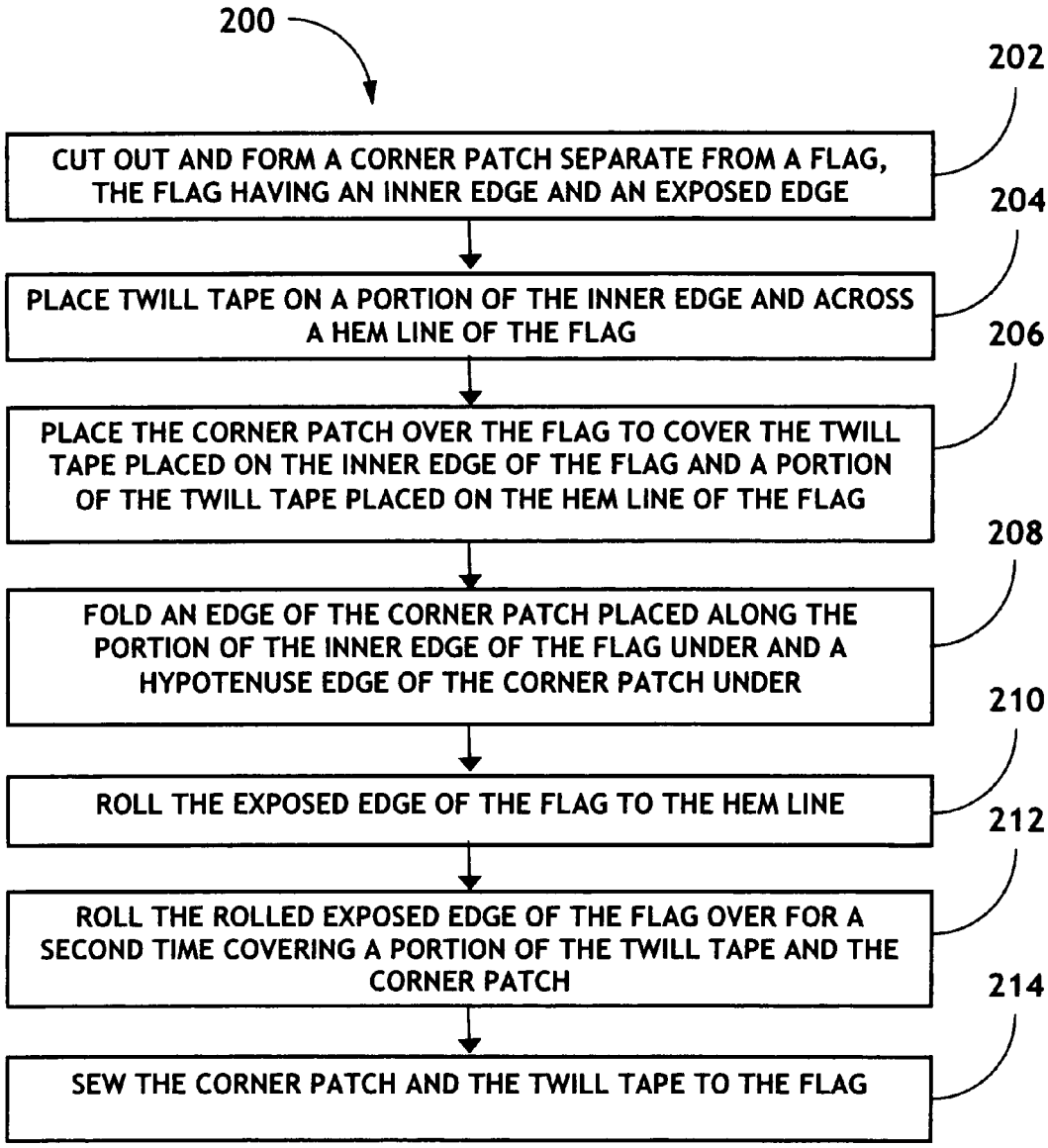
FIG. 2 is a flow diagram illustrating a method of flag reinforcement, in accordance with an exemplary embodiment of the present invention.
Figure 6A:
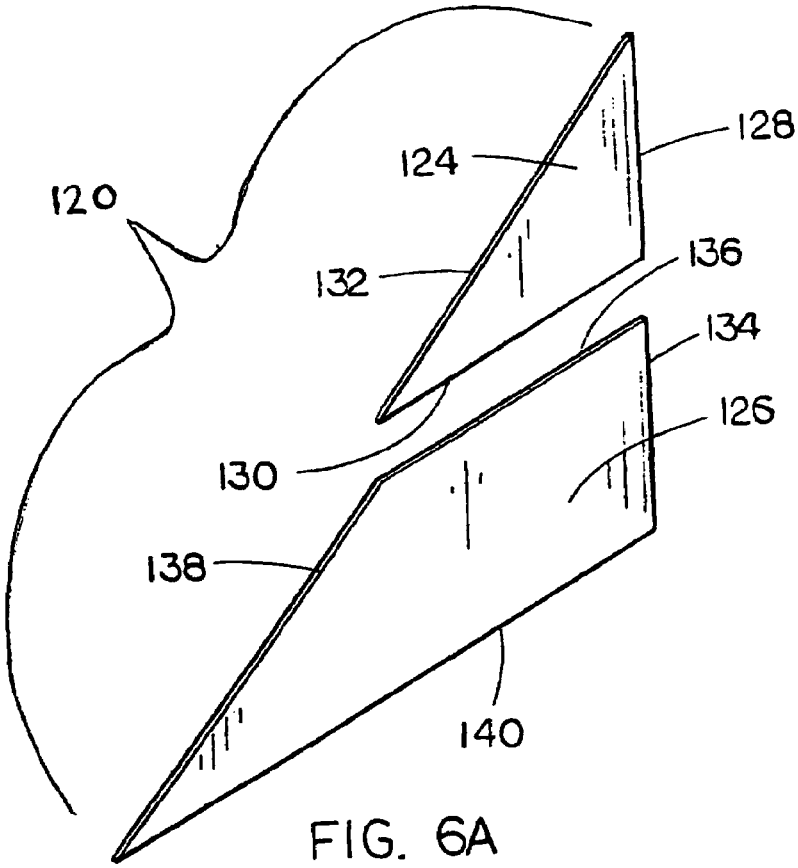
FIGS. 6A and 6B are isometric views illustrating flag restoration and/or flag reinforcement, in accordance with an exemplary embodiment of the present invention, wherein a corner patch and corner patch production are shown.
Figure 6B:
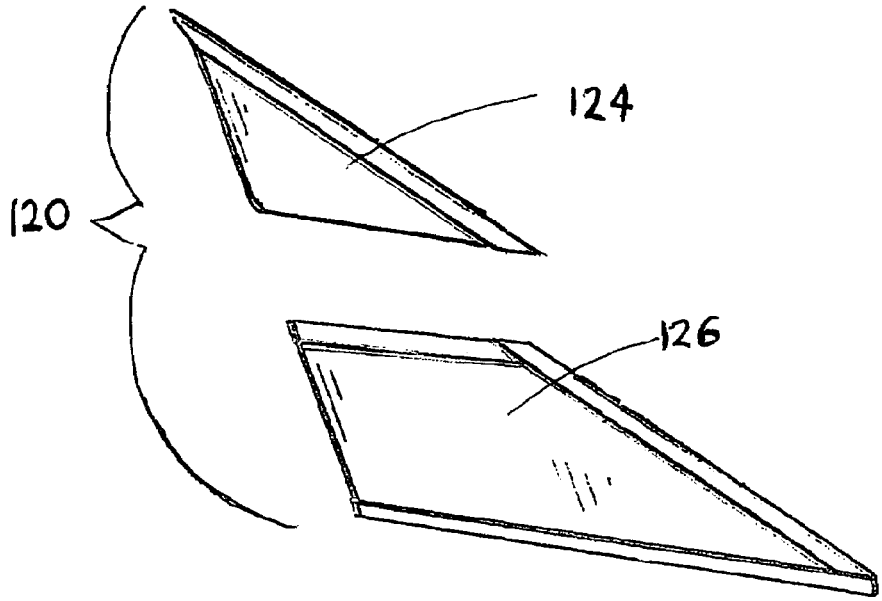
Figure 7:
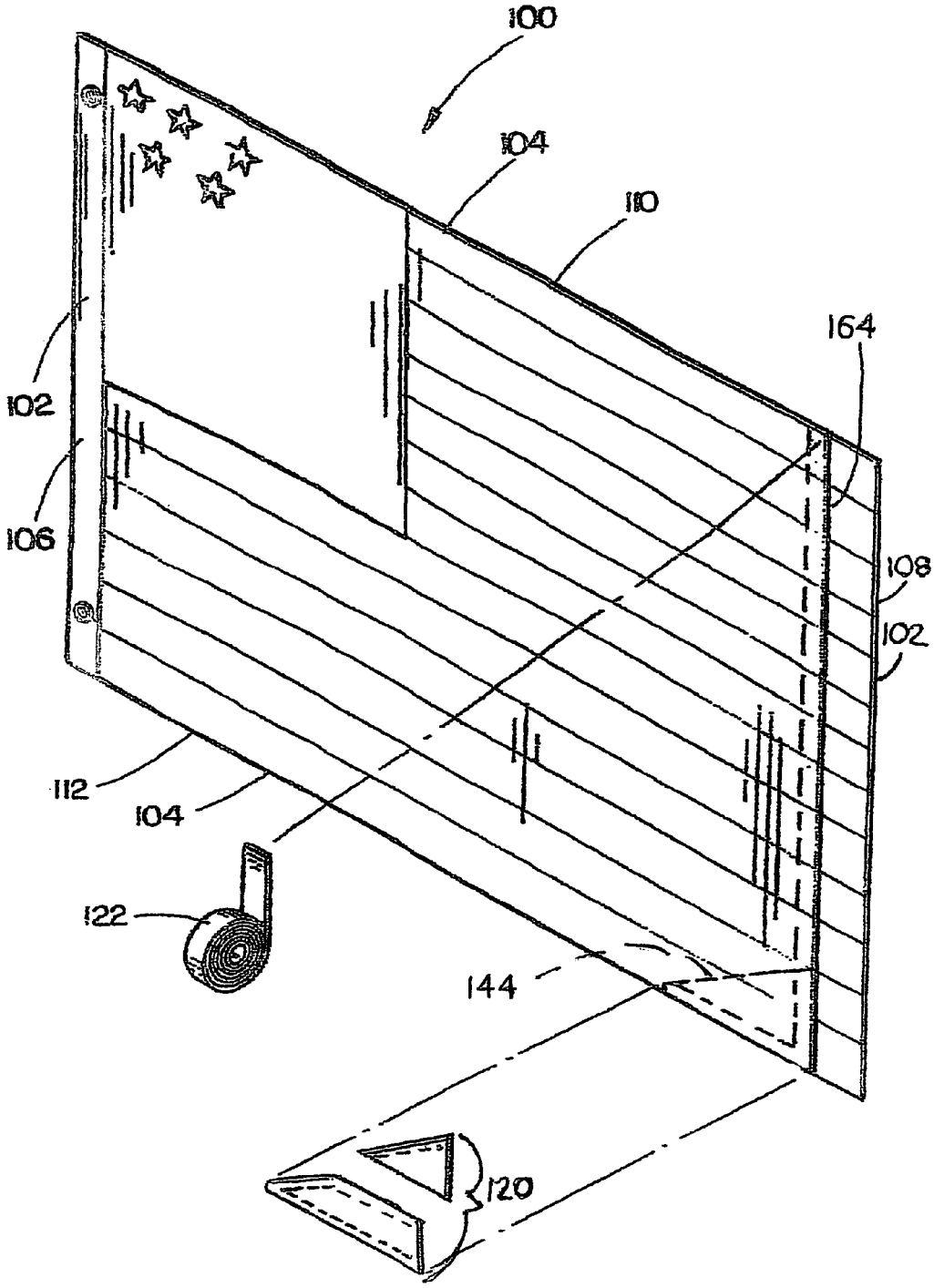
FIG. 7 is an exploded isometric view illustrating flag restoration and/or flag reinforcement, in accordance with an exemplary embodiment of the present invention, wherein the corner patch is placed on top of the flag and twill tape.

Referring to FIG. 2, a method for reinforcing a flag 200 is shown in accordance with exemplary embodiments of the present invention. Method 200 cuts out and forms a corner patch 120 separate from the flag 100, 202, as illustrated in FIGS. 6A and 6B. The corner patch 120 is in the shape of triangle and includes a right angle across from a hypotenuse 144 as illustrated in FIG. 7. In one embodiment the corner patch 120 is comprised of two separate pieces of material 124 and 126 that match the material of the exposed corner being reinforced as illustrated in FIGS. 6A and 6B. It is contemplated that the angle may be greater or less than 90 degrees without departing from the scope and intent of the present invention.

Figure 8:
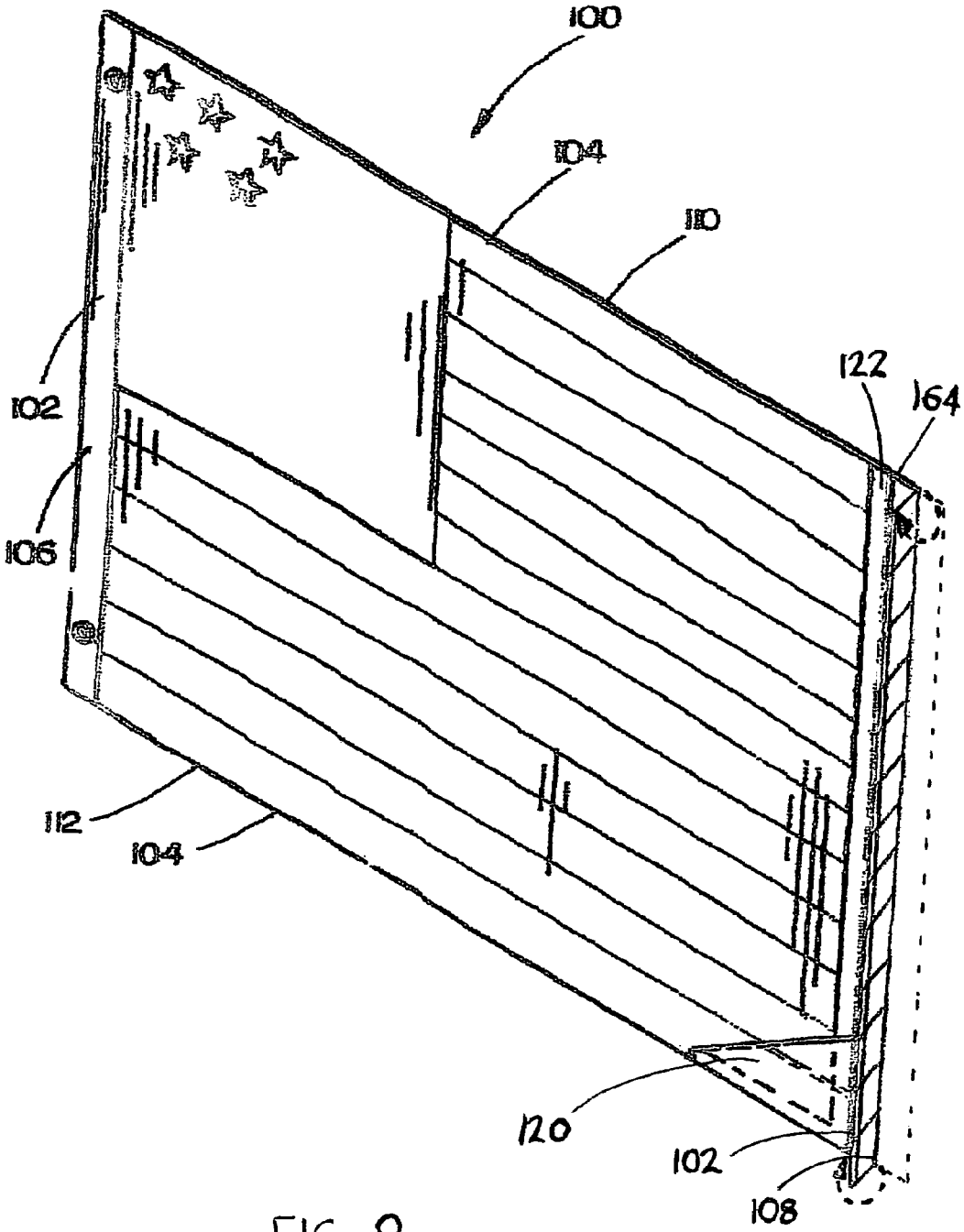
FIG. 8 is an isometric view illustrating flag restoration and/or flag reinforcement, in accordance with an exemplary embodiment of the present invention, wherein the exposed edge of the flag is rotted over to the hem line.

Method 200 places twill tape 122 on a portion of an inner edge 104 and across a hem line 164, 204, as illustrated in FIGS. 1, 7, and 8. The hem line is an imaginary line interior and parallel to the exposed edge 108 of the flag 100. For instance, twill tape 122 is made mostly of cotton and may also be referred to as cotton webbing. In a specific embodiment, the twill tape is comprised of 100% cotton. In one embodiment, the twill tape 122 is placed on the flag 100 in one continuous piece. In another embodiment, the twill tape 122 is placed on the flag 100 in two separate pieces. It is contemplated that a liner other than twill tape may be utilized without departing the scope and intent of the present invention.

Method 200 places the corner patch 120 over the flag 100 to cover the twill tape 122 placed on the inner edge 104 of the flag and a portion of the twill tape 122 placed on the hem line 164 of the flag 100, 206, as illustrated in FIG. 7. The right angle of the corner patch 120 is aligned with the corner of the flag formed by the hem line and the inner edge, as illustrated in FIG. 7. In one embodiment, the fabric of the corner patch 120 mirrors the corner of the flag formed by the hem line 164 and the inner edge 104 of the flag 100 being reinforced and/or restored.

Method 200 folds an edge of the corner patch placed along the portion of the inner edge of the flag under and a hypotenuse edge 144 of the corner patch under, 208, as illustrated in FIG. 6B.

In one embodiment, the corner patch is for a United States of America flag. Referring to FIG. 6, a corner patch and corner patch formation for a United States of America flag is shown in accordance with exemplary embodiments of the present invention. The corner patch 120 is formed from two separate pieces of fabric one white triangular piece 124 and one red polygon piece 126. The white triangular piece 124 has three sides, side one 128, side two 130, and side three, a hypotenuse, 132 across from a right angle (90°). The red polygon piece 126 has four sides, side four 134, side five 136, side six 138, and side seven 140. Side four 134 and side seven 140 of the red piece of fabric 126 meet to form a right angle. The colors utilized in this embodiment are not meant to be restrictive of the present invention. It is contemplated that the corner patch may be any color or print to allow the corner patch to match the color and/or print of the flag being restored without departing from the scope and intent of the present invention.

Figure 3:
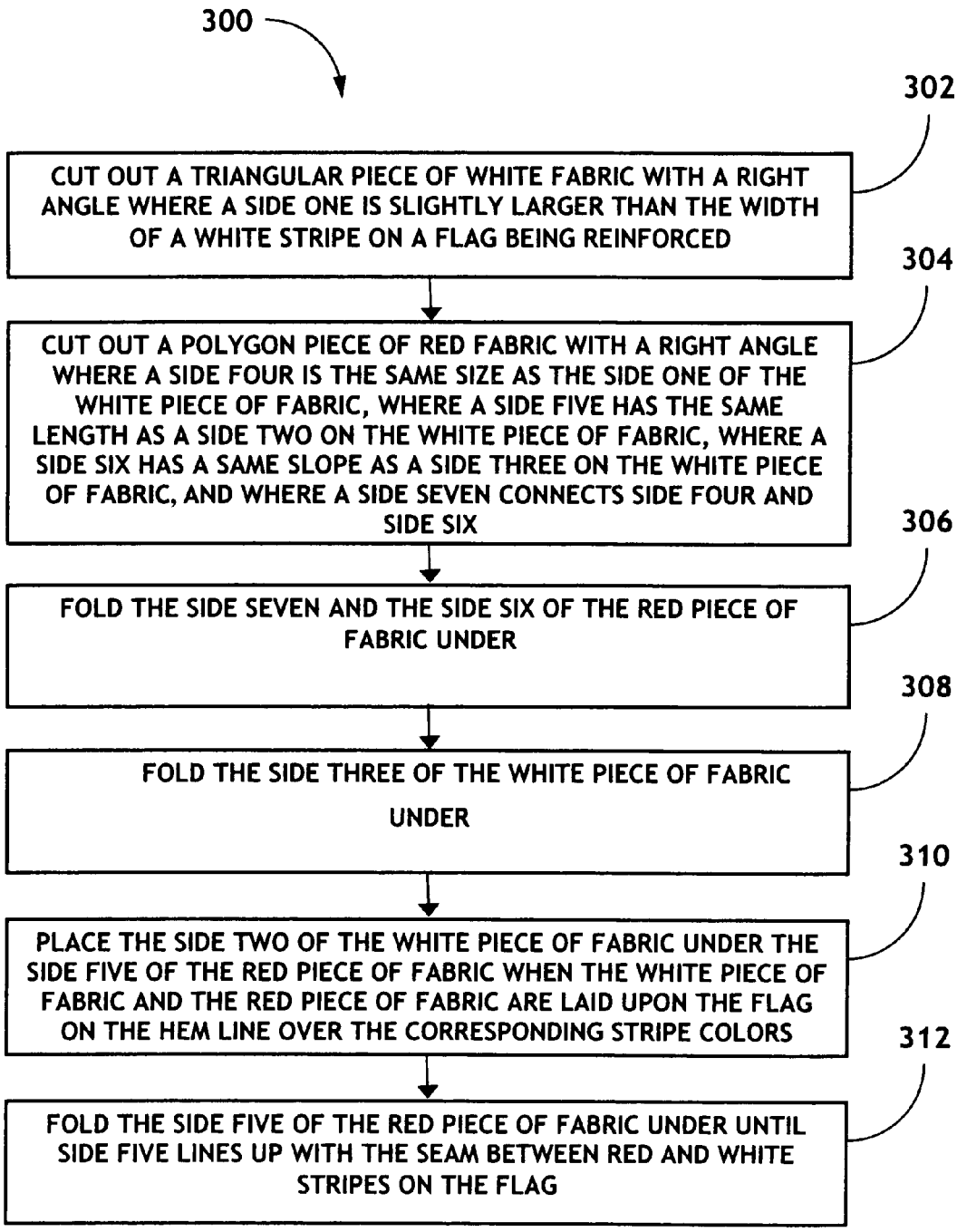
FIG. 3 is a flow diagram illustrating a method for forming and placing a corner patch comprising two pieces of material on a United States of America flag, in accordance with an exemplary embodiment of the present invention.

Referring to FIG. 3, a flow diagram of a method for forming and placing a corner patch comprising two pieces of material on a United States of America flag 300 is shown in accordance with exemplary embodiments of the present invention. Method 300, cuts out a triangular piece of white fabric 124 with a right angle where a side one 128 is slightly larger than the width of a white stripe on a flag being reinforced 302, as illustrated in FIG. 6A. As used herein "slightly larger" refers to about ½ inches to about 1½ inches.

Method 300 cuts out a polygon piece of red fabric 126 with a right angle where a side four 134 is the same size as the as the side one 128 of the white piece of fabric 124, where a side five 136 has the same length as a side two 130 on the white piece of fabric 124, where a side six 138 has a same slope as a hypotenuse or a side three 132 on the white piece of fabric 126, and where a side seven 140 connects side four 134 and side six 138, 304, as illustrated in FIG. 6A.

Method 300, folds the side seven 140 and the side six 138 of the red piece of fabric 124 under, 306, as illustrated in FIG. 6B. Method 300 folds the side three 132 of the white piece of fabric 126 under, 308, as illustrated in FIG. 6B. Method 300 places the side two 130 of the white piece of fabric 124 under the side five 136 of the red piece of fabric 126 when the white piece of fabric 124 and the red piece of fabric 126 are laid upon the flag on the hem line 164 over the corresponding stripe colors, 310, as illustrated in FIG. 7. For example, the red piece of fabric 126 is aligned over a red stripe and the white piece of fabric 124 is aligned over a white stripe. Method 300 folds the side five 136 of the red piece of fabric 126 under until side five 136 lines up with the seam between red and white stripes on the flag, 312, to form the corner patch for a United State of America flag, as illustrated in FIG. 8.

It is contemplated that method 300 may be utilized for flags other than the United States of America flag, which have two different prints or colors found in the exposed corner of the flag being reinforce and/or restored, without departing from the scope and intent of the present invention. For example, the white triangular piece of fabric 124 utilized in method 300 may be replaced with a first triangular piece of fabric that matches the color and/or pattern of the flag being reinforced and/or restored. Furthermore, the red polygon piece of fabric 126 of method 300 may be replaced with a second polygon piece of fabric that matches the color and/or pattern of the flag being reinforced and/or restored. It is understood that one piece of material may be utilized as the corner patch for flags that only have one type of material and or color over a portion of the hem line and the inner edge to reinforce and/or restore the flag without departing from the scope and intent of the present invention.

Figure 9:
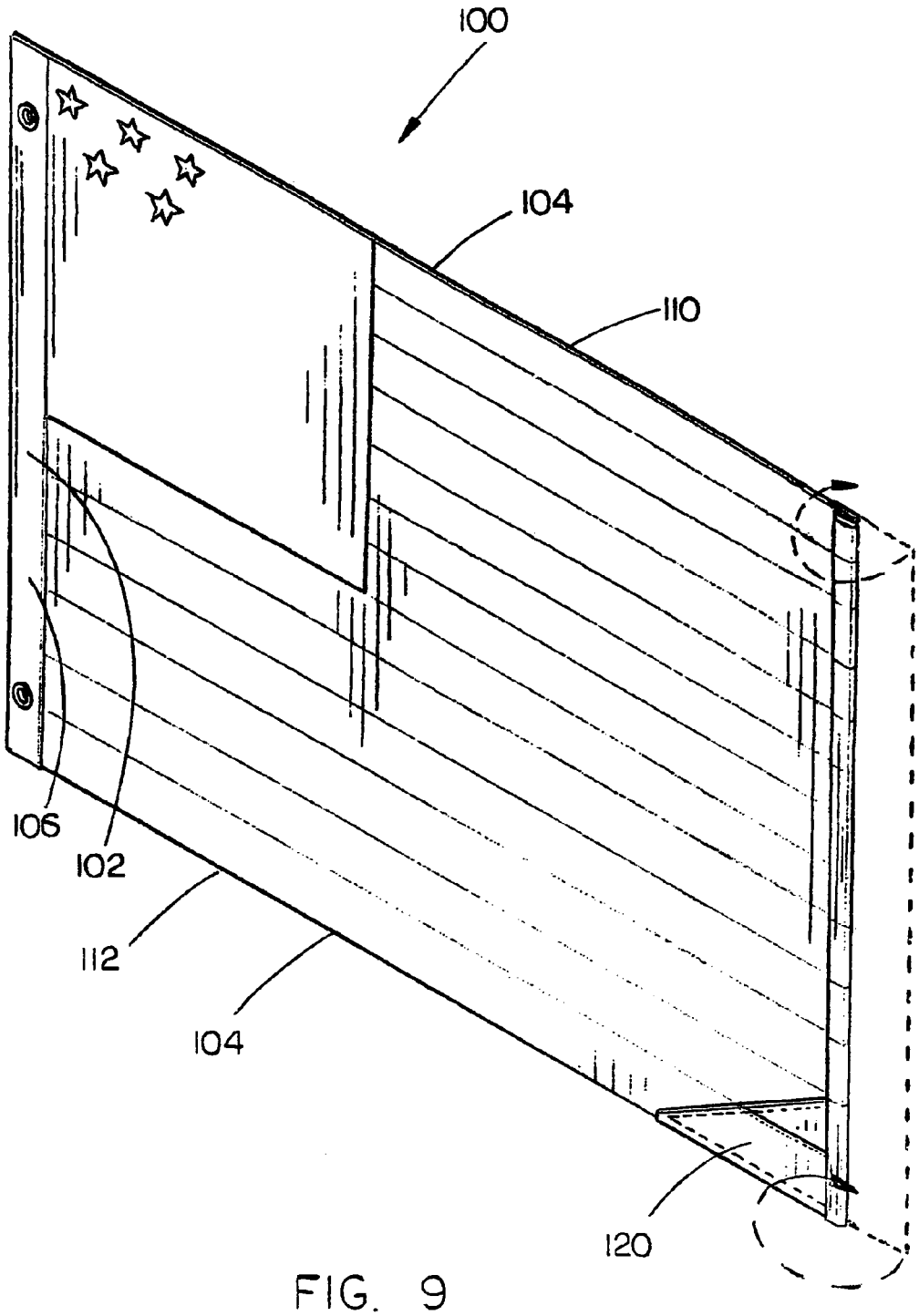
FIG. 9 is an isometric view illustrating flag restoration and/or flag reinforcement, in accordance with an exemplary embodiment of the present invention, wherein the exposed edge of the flag is rotted over for a second time covering the twill tape and the corner patch.
Figure 10A:
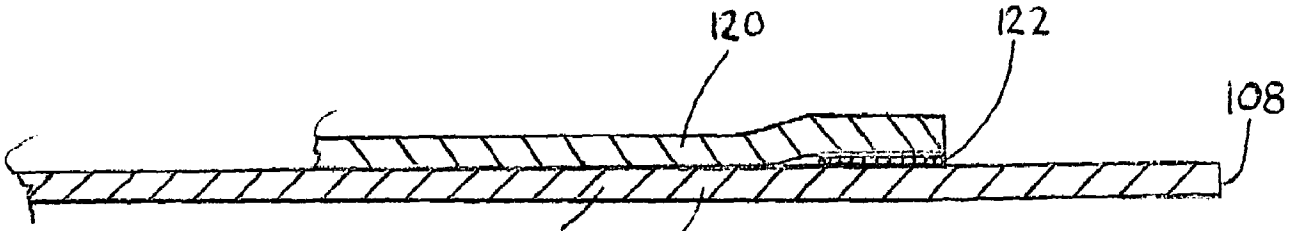
FIGS. 10A, 10B, and 10C illustrate partial cross-sectional side views of FIGS. 7, 8, and 9.
Figure 10B:
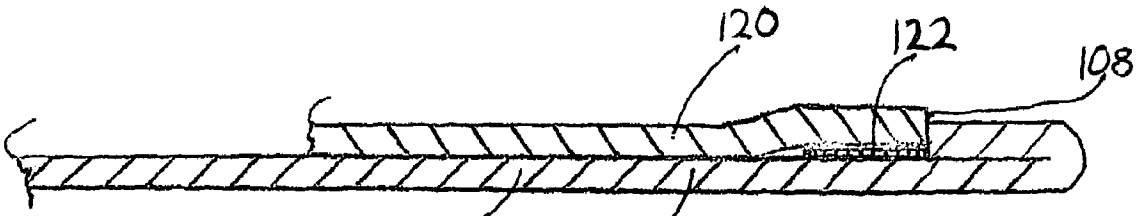
Figure 10C:
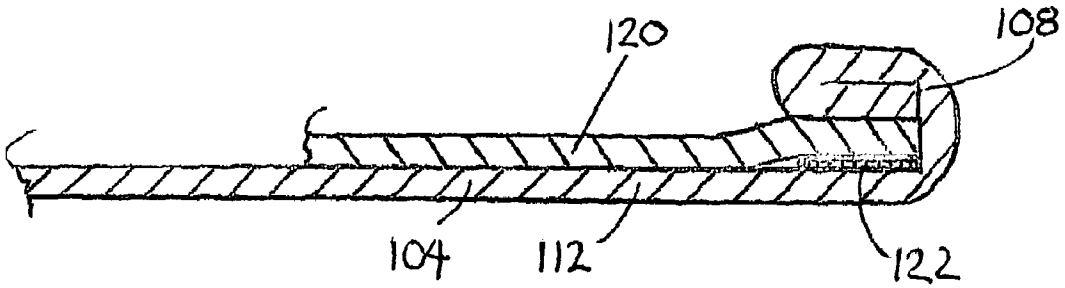

Method 200 rolls the exposed edge 108 of the flag 100 to the hem line 164, 210, as illustrated in FIG. 8 and FIG. 10B. Method 200 rolls the rolled exposed edge of the flag 100 over for a second time covering a portion of the twill tape and a portion of the corner patch, 212, as illustrated in FIGS. 9 and 10C.

Figure 11A:
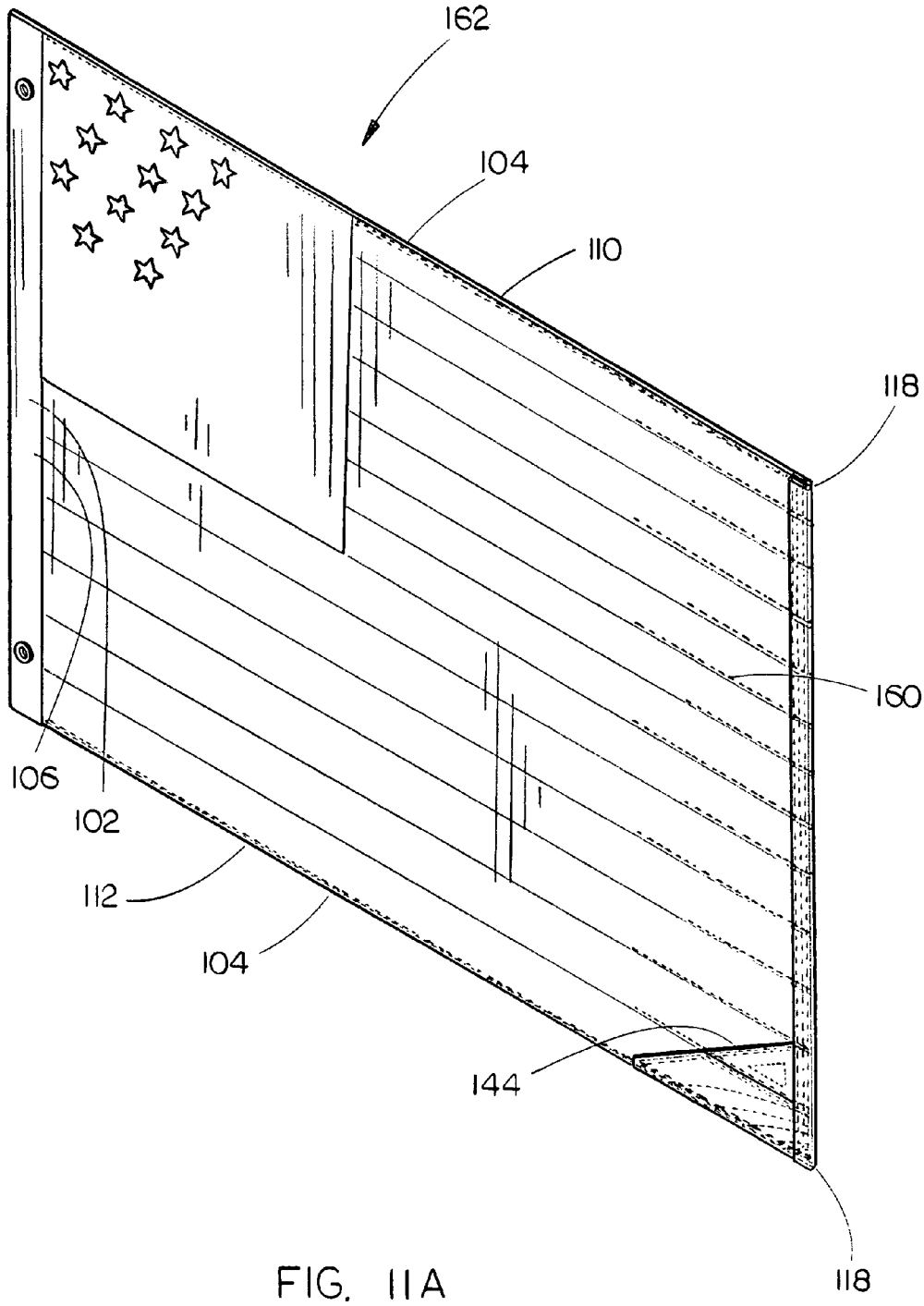
FIG. 11A is an isometric view illustrating a restored flag and/or a reinforced flag, in accordance with an exemplary embodiment of the present invention.
Figure 11B:
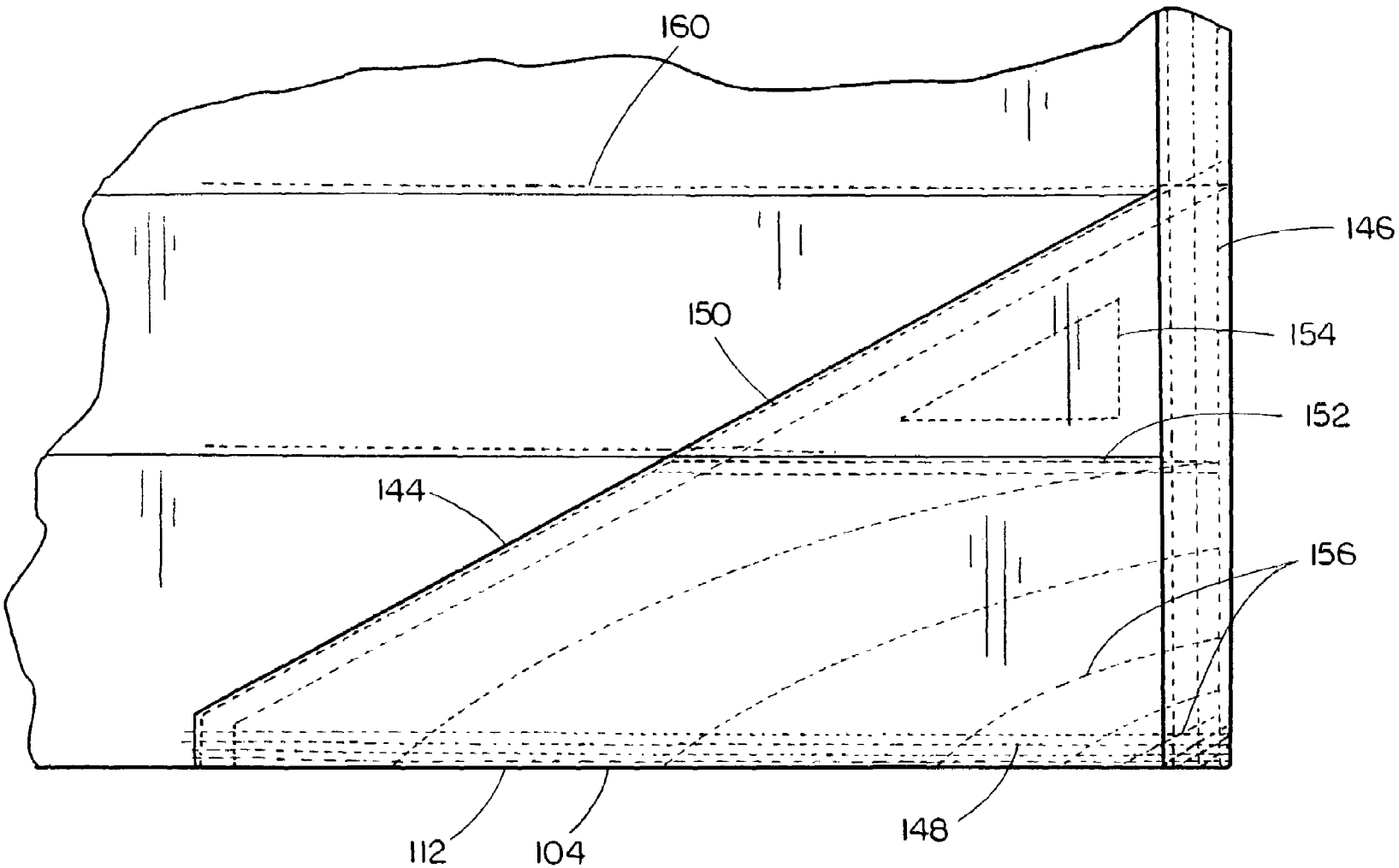
FIG. 11B is a partial front view illustrating a restored flag and/or a reinforced flag, in accordance with an exemplary embodiment of the present invention.

Method 200 sews the corner patch 120 and the twill tape 122 to the flag 100, 214, as illustrated in FIG. 11, to form a reinforced flag 162. In one embodiment the corner patch is pinned to the flag prior to and/or during sewing. In another embodiment, the twill tape and corner patch are pinned to the flag prior to and/or during sewing. In another embodiment, the corner patch and the folded edges are ironed before and/or after being placed upon the flag.

Figure 4:
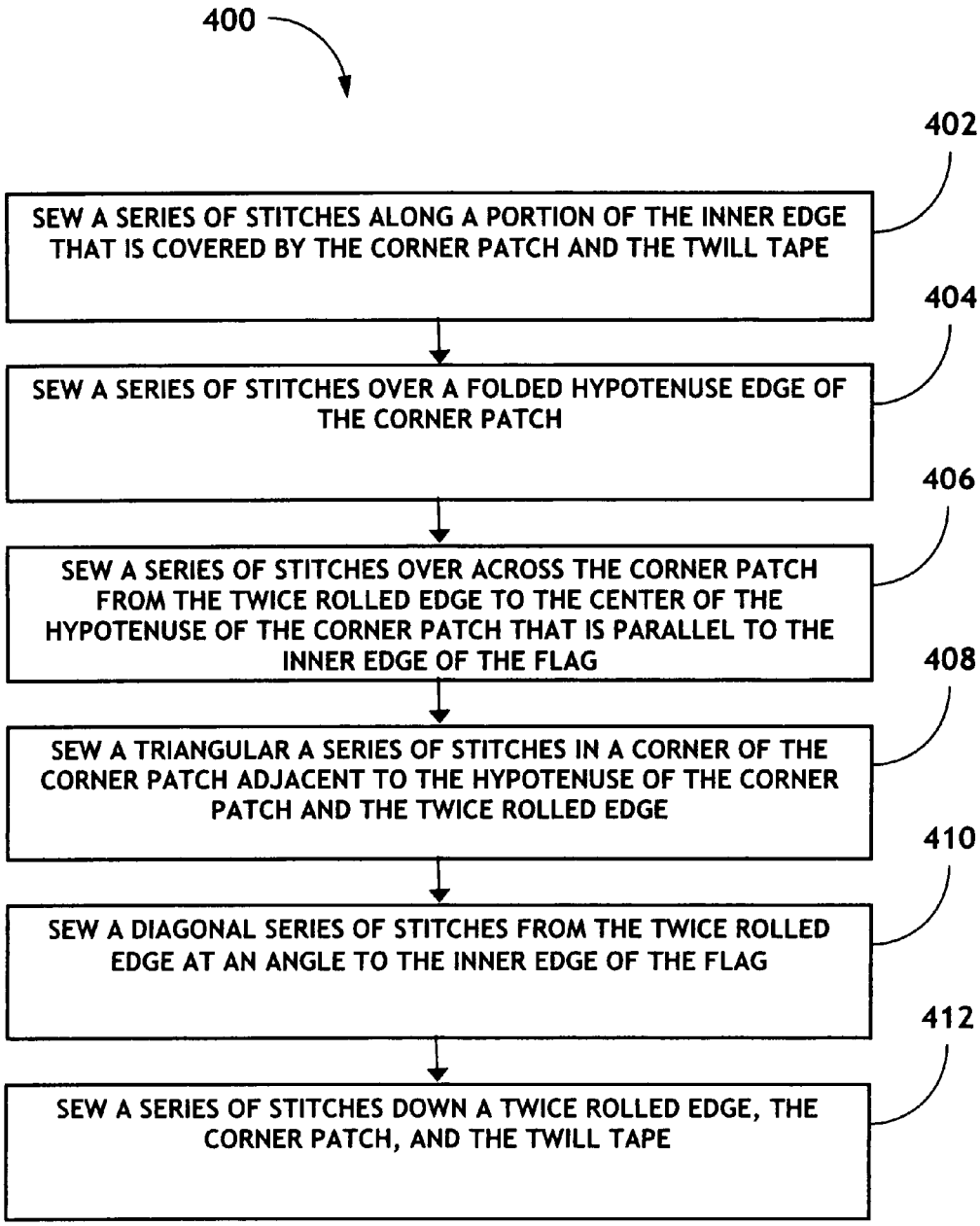
FIG. 4 is a flow diagram illustrating a method for sewing a corner patch and twill tape to a flag, in accordance with an exemplary embodiment of the present invention.

Referring to FIG. 4, a flow diagram of a method for sewing a corner patch onto a flag to reinforce and/or restore a flag 400 is shown in accordance with exemplary embodiments of the current invention. Method 400 sews a series of stitches 148 along a portion of the inner edge 102 that is covered by the corner patch 120 and the twill tape 122, 402, as illustrated in FIG. 11. A "stitch" as used herein is one complete movement of a needle and thread through fabric or material forming a single loop or portion of thread left in the fabric. A "series of stiches" as used herein refers to a grouping of two or more stitches formed in row with one continuous piece of thread. Method 400 sews a series of stitches 150 over the folded hypotenuse edge 144 of the corner patch 120, 404, as illustrated in FIG. 11. Method 400 sews a series of stitches 152 across the corner patch 120 from the twice rolled edge to the center of the hypotenuse 144 of the corner patch 120 that is parallel to the inner edge 104 of the flag 100, 406, as illustrated in FIG. 11. Method 400 sews a triangular series of stitches 154 in a corner of the corner patch 120 that is adjacent to twice rolled edge of the flag 100 and the hypotenuse 144 of the corner patch 120, 408, as illustrated in FIG. 11. Method 400 sews a diagonal series of stitches 156 from the twice rolled edge at angle to the inner edge 104 of the flag 100, 410, as illustrated in FIG. 11. Method 400 sews a series of stitches 146 down the twice rolled edge, corner patch, and twill tape 122, 412, as illustrated in FIG. 11.

In another embodiment, the thread color of the series of stitches matches the color of the flag 100 and corner patch 120 being sewn. In a further embodiment, the thread is a heavy duty thread that is UV and moisture resistant, such as a synthetic bonded thread. For example, the thread may be 138 sized. For instance, the thread may be Nu Bond twisted non-wick polyester thread at size 138 produced by American and Efird, Inc. located at P.O. Box 57, 22 American Street, Mount Holly, N.C. 28120. In a still further embodiment, the corner patch may be in any color or print to match the exposed corner of the flag being reinforced or restored.

In a specific embodiment, three series of stitches 146 are made that cross over the series of stitches 148. In another specific embodiment, four series of stitches 148 are made that cross over the series of stitches 146. In a further specific embodiment, three series of stitches 150 are made. In a still further specific embodiment, two series of stitches 152 are made. In an additional specific embodiment, eight series of stitches 156 are made with four of the eight series of stitches 156 crossing the series of stitches 148 and the series of stitches 146. In another specific embodiment, a series of stitches 160 may be made on a portion of any seam that meets the exposed edge 108 starting from the exposed edge 108, as illustrated in FIG. 11. For example, in a United States of America flag seams formed between the red and white stripes meet the exposed edge. In a more specific embodiment, the series of stitches 160 may cover a third of the seam that abuts the exposed edge. In a still further specific embodiment, series of stitches 160 may cover the entire length of seam that abuts the exposed edge 108.

Figure 12:
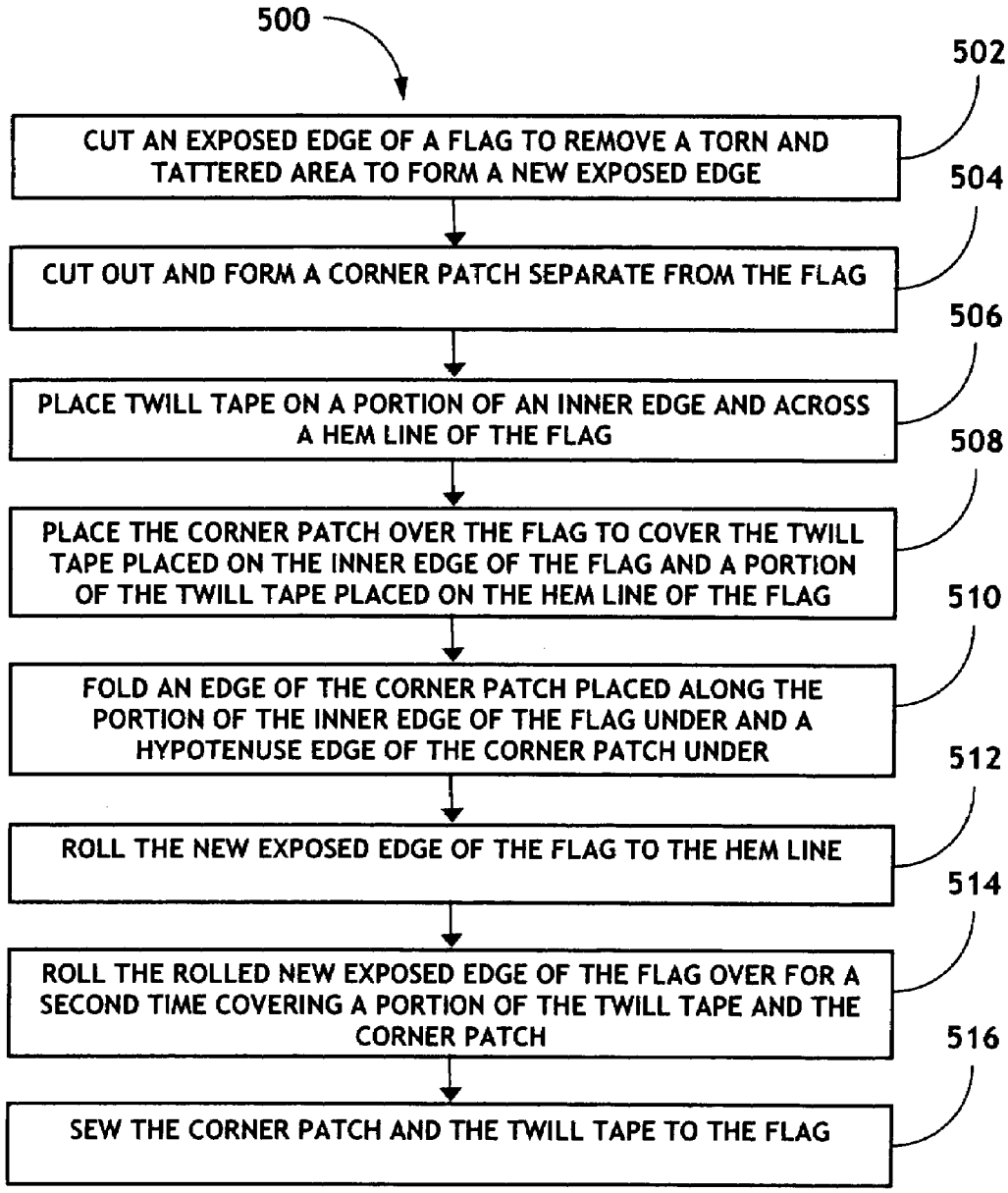
FIG. 12 is a flow diagram illustrating a method of flag restoration, in accordance with an exemplary embodiment of the present invention.

Referring now to FIG. 12 a method for restoring a torn and tattered flag 500 is shown in accordance with exemplary embodiments of the present invention. Method 500 cuts across an exposed edge 108 of a flag 100 to remove a torn and tattered area 118, 502, as illustrated in FIG. 5. Method 500 cuts out and forms a corner patch separate from the flag, 504. Method 500 places twill tape on a portion of an inner edge and across a hem line of the flag, 506. Method 500 places the corner patch over the flag to cover the twill tape placed on the inner edge of the flag and a portion of the twill tape placed on the hem line of the flag, 508. Method 500 folds an edge of the corner patch placed along the portion of the inner edge of the flag under and a hypotenuse edge of the corner patch under, 510. Method 500 rolls the exposed edge of the flag to the hem line, 512. In one embodiment, method 500 rolls the rolled exposed edge of the flag over for a second time covering a portion of the twill tape and a portion of the corner patch, 514. Method 500 sews the corner patch and the twill tape to the flag, 516. The previously described method 300 for forming a corner patch for a United States of America flag and method 400 for sewing a corner patch onto a flag to reinforce and/or restore a flag may be similarly applied to method 500 for restoring a flag.

Referring now to FIG. 11 a reinforced and/or restored flag 162 of the present invention is shown in accordance with the exemplary embodiments of the present invention. A reinforced flag comprises a flag 100, twill tape 122 placed along the hem line 164 and a portion of at least one inner edge 104 of the flag 100, and at least one corner patch 120 placed over a portion of the twill tape placed along the hem line, and the twill tape placed on the at least one inner edge. The twill tape 122 and corner patch 120 are sewn to the flag 100 after the exposed edge 108. The twill tape and corner patch are sewn to the flag after the exposed edge is rolled over forming a durable flag that does not distract from the appearance of the flag.

A restored flag comprises a portion of a flag having an inner edge and a new exposed edge, twill tape 122 placed along a hem line 164 and a portion of at least one inner edge 104 of the portion of the flag; and at least one corner patch 120 placed over a portion of the twill tape placed along the hem line, and the twill tape placed on the at least one inner edge. The twill tape 122 and corner patch 120 are sewn to the portion of the flag 100 after the new exposed edge is rolled over twice forming a durable flag that does not distract from the appearance of the flag. The portion of the flag had a torn and tattered portion removed by cutting across an exposed edge of the flag to form the new exposed edge A reinforced flag is more durable than a flag that is not reinforced. Therefore, a reinforced flag will not tear and/or tatter as soon as a flag that is not reinforced when flown outside through the same conditions. In one embodiment, the reinforced flag may be flown outside in the same conditions for twice as long as a flag that is not reinforced without tattering and/or tearing. The reinforced and/or restored flag is more durable because no single layered seams are present on an exposed corner and because the exposed corners, which receive the most stress, have been strengthened by the addition of the corner patch and twill tape.

In exemplary embodiments of the invention, the methods disclosed may be implemented as sets of instructions, through a single production device, and/or through multiple production devices. Further, it is understood that the specific order or hierarchy of steps in the methods disclosed are examples of exemplary approaches. Based upon design preferences, it is understood that the specific order or hierarchy of steps in the method can be rearranged while remaining within the scope and spirit of the present invention. The accompanying method claims present elements of the various steps in a sample order, and are not necessarily meant to be limited to the specific order or hierarchy presented.

It is believed that the present invention and many of its attendant advantages wilt be understood by the foregoing description, and it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A reinforced flag, comprising:

a flag having at least one inner edge and an exposed edge;

twill tape placed along a hem line and along a portion of the at least one inner edge of the flag; and at least one corner patch placed along a portion of the twill tape placed along the hem line, wherein the twill tape and corner patch are sewn to the flag after the exposed edge is rolled over forming a durable flag that does not distract from the appearance of the flag.

2. The reinforced flag claimed in claim 1, wherein the twill tape and the corner patch are sewn to the flag with a series of stitches along the portion of the inner edge that is covered by the corner patch and the twill tape; a series of stitches over a folded hypotenuse edge of the corner patch; a series of stitches across the corner patch from the rolled exposed edge to the center of the hypotenuse of the corner patch that is parallel to the inner edge of the flag; a triangular series of stitches is made in a corner of the corner patch adjacent to the hypotenuse of the corner patch and the rolled exposed edge; a series of diagonal stitches from a twice rolled edge at an angle to the inner edge of the flag; and a series of stitches are made down the twice rolled exposed edge, corner patch, and twill tape.

3. The reinforced flag claimed in claim 1, wherein three series of stitches are made along a portion of the inner edge that is covered by the corner patch and the twill tape; three series of stitches are made over the folded hypotenuse edge of the corner patch; two series of stitches are made across the corner patch from the rolled exposed edge to the center of the hypotenuse of the corner patch that is parallel to the inner edge of the flag; eight series of diagonal stitches from the twice rolled edge at an angle to the inner edge of the flag; and three series of stitches are made down a rolled exposed edge, corner patch, and twill tape.

4. The reinforced flag claimed in claim 1, wherein a series of stitches is added over a portion of a seam that meets the exposed edge of the flag.

5. The reinforced flag claimed in claim 1, wherein material utilized for the corner patch matches the flag and thread utilized for sewing matches the color of the flag where the thread is being utilized.

6. A restored flag, comprising:

a portion of a flag, the portion of the flag having an inner edge and a new exposed edge;

twill tape placed along a hem line and a portion of the inner edge of the portion of the flag; and at least one corner patch placed along a portion of the twill tape placed along the hem line, wherein the portion of the flag had a torn and tattered portion removed by cutting across an exposed edge of the flag to form the new exposed edge and wherein the twill tape and the corner patch are sewn to the portion of the flag after the new exposed edge is rolled over forming a durable flag that does not distract from the appearance of the flag.

7. The reinforced flag claimed in claim 6, wherein the twill tape and the corner patch are sewn to the flag with a series of stitches along the portion of the inner edge that is covered by the corner patch and the twill tape; a series of stitches over a folded hypotenuse edge of the corner patch; a series of stitches across the corner patch from the rolled new exposed edge to the center of the hypotenuse of the corner patch that is parallel to the inner edge of the flag; a triangular series of stitches is made in a corner of the corner patch adjacent to the hypotenuse of the corner patch and the rolled new exposed edge; a series of diagonal stitches from a twice rolled edge at an angle to the inner edge of the flag; and a series of stitches are made down the twice rolled new exposed edge, corner patch, and twill tape.

8. The reinforced flag claimed in claim 6, wherein three series of stitches are made along a portion of the inner edge that is covered by the corner patch and the twill tape; three series of stitches are made over the folded hypotenuse edge of the corner patch; two series of stitches are across the corner patch from the rolled new exposed edge to the center of the hypotenuse of the corner patch that is parallel to the inner edge of the flag; eight series of diagonal stitches from the twice rolled edge at an angle to the inner edge of the flag; and three series of stitches are made down a rolled new exposed edge, corner patch, and twill tape.

9. The restored flag claimed in claim 6, wherein a series of stitches is added over a portion of a seam that meets the new exposed edge of the flag.

10. The restored flag claimed in claim 6, wherein material utilized for the corner patch matches the flag and thread utilized for sewing matches the color of the flag where the thread is being utilized.

11. A method for reinforcing a flag, comprising:

cutting out and forming a corner patch separate from a flag, the flag having an inner edge and an exposed edge;

placing twill tape on a portion of the inner edge and across a hem line of the flag:

placing the corner patch over the flag to cover the twill tape placed on the inner edge of the flag and a portion of the twill tape placed on the hem line of the flag;

folding an edge of the corner patch placed along the portion of the inner edge of the flag under and a hypotenuse edge of the corner patch under;

rolling the exposed edge of the flag to the hem line;

rolling the rolled exposed edge of the flag over for a second time covering a portion of the twill tape and a portion of the corner patch; and sewing the corner patch and the twill tape to the flag, wherein the sewing does not distract from the appearance of the flag and creates a flag that is durable.

12. The method as claimed in claim 11, wherein the cutting out and forming a corner patch separate from a flag, comprises:

cutting out a first triangular piece of fabric with a right angle where a side one is slightly larger the width of a stripe on a flag being reinforced;

cutting out a second polygon piece of fabric with a right angle where a side four is the same size as the side one of the first triangular piece of fabric, where a side five has the same length as a side two on the first triangular piece of fabric, where a side six has a same slope as a side three on the first triangular piece of fabric, and where a side seven connects side four and side six;

folding the side seven and the side six of the second polygon piece of fabric under;

folding the side three of the first triangular piece of fabric under;

placing the side two of the first triangular piece of fabric under the side five of the second polygon piece of fabric when the first triangular piece of fabric and the second polygon piece of fabric are laid upon the flag on the hem line over a portion of the twill tape placed upon the hem line and over the twill tape place upon the inner edge; and folding the side five of the second polygon piece of fabric under until the second polygon piece of fabric and the first triangular piece of fabric overlap directly over a seam of the stripe on the flag.

13. The method as claimed in claim 11, wherein the sewing the corner patch and the twill tape to the flag comprises:

sewing a series of stitches along a portion of the inner edge that is covered by the corner patch and the twill tape;

sewing a series of stitches over the folded hypotenuse edge of the corner patch;

sewing a series of stitches across the corner patch from the twice rolled exposed edge to the center of the hypotenuse of the corner patch that is parallel to the inner edge of the flag;

sewing a triangular series of stitches in a corner of the corner patch adjacent to the hypotenuse of the corner patch and the twice rolled exposed edge;

sewing a diagonal series of stitches from the twice rolled exposed edge at an angle to the inner edge of the flag; and sewing a series of stitches down the twice rolled exposed edge, the corner patch, and the twill tape.

14. The method as claimed in claim 11, wherein the sewing the corner patch and the twill tape to the flag comprises:

sewing three series of stitches along a portion of the inner edge that is covered by the corner patch and the twill tape;

sewing three series of stitches over the folded hypotenuse edge of the corner patch;

sewing two series of stitches across the corner patch from the twice rolled exposed edge to the center of the hypotenuse of the corner patch that is parallel to the inner edge of the flag;

sewing a triangular series of stitches in a corner of the corner patch adjacent to the hypotenuse of the corner patch and the twice rolled exposed edge;

sewing eight diagonal series of stitches from the twice rolled exposed edge at an angle to the inner edge of the flag; and sewing three series of stitches down the twice rolled exposed edge, corner patch, and twill tape, wherein four of the eight diagonal series of stitches cross over the three series of stitches made down the twice rolled exposed edge, corner patch, and twill tape that cross over the four series of stitches made along the inner edge that is covered by the corner patch and the twill tape.

15. The method as claimed in claim 11, wherein a series of stitches is sewn down a portion of any seam that reaches the exposed edge of the flag.

16. A method for restoring a torn or tattered flag, comprising:

cutting across an exposed edge of a flag to remove a torn and tattered area to form a new exposed edge;

cutting out and forming a corner patch separate from the flag;

placing twill tape on a portion of an inner edge and across the hem line of the flag;

placing the corner patch over the flag to cover the twill tape placed on the inner edge of the flag and a portion of the twill tape placed on the hem line of the flag;

folding an edge of the corner patch placed along the portion of the inner edge of the flag under and a hypotenuse edge of the corner patch under;

rolling the new exposed edge to the hem line;

rolling the rolled new exposed edge of the flag over for a second time covering a portion of the twill tape and a portion of the corner patch; and sewing the corner patch and the twill tape to the flag, wherein the sewing does not distract from the appearance of the flag and creates a flag that is durable.

17. The method as claimed in claim 16, wherein the cutting out and forming a corner patch separate from the flag, comprises:

cutting out a first triangular piece of fabric with a right angle where a side one is slightly larger the width of a stripe on a flag being reinforced;

cutting out a second polygon piece of fabric with a right angle where a side four is the same size as the side one of the first triangular piece of fabric, where a side five has the same length as a side two on the first triangular piece of fabric, where a side six has a same slope as a side three on the first triangular piece of fabric, and where a side seven connects side four and side six;

folding the side seven and the side six of the second polygon piece of fabric under;

folding the side three of the first triangular piece of fabric under;

placing the side two of the first triangular piece of fabric under the side five of the second polygon piece of fabric when the first triangular piece of fabric and the second polygon piece of fabric are laid upon the flag on the hem line over a portion of the twill tape placed upon the hem line and over the twill tape place upon the inner edge; and folding the side five of the second polygon piece of fabric under until the second polygon piece of fabric and the first triangular piece of fabric overlap directly over a seam of the stripe on the flag.

18. The method as claimed in claim 16, wherein sewing the corner patch and the twill tape to the flag comprises:

sewing a series of stitches along a portion of the inner edge that is covered by the corner patch and the twill tape;

sewing a series of stitches over the folded hypotenuse edge of the corner patch;

sewing a series of stitches across the corner patch from the twice rolled new exposed edge to the center of the hypotenuse of the corner patch that is parallel to the inner edge of the flag;

sewing a triangular series of stitches in a corner of the corner patch adjacent to the hypotenuse of the corner patch and the twice rolled new exposed edge;

sewing a diagonal series of stitches from the twice rolled new exposed edge at an angle to the inner edge of the flag; and sewing a series of stitches down the twice rolled new exposed edge, the corner patch, and the twill tape.

19. The method as claimed in claim 16, wherein the sewing the corner patch and the twill tape to the flag comprises:

sewing three series of stitches along a portion of the inner edge that is covered by the corner patch and the twill tape;

sewing three series of stitches over the folded hypotenuse edge of the corner patch;

sewing two series of stitches across the corner patch from the twice rolled new exposed edge to the center of the hypotenuse of the corner patch that is parallel to the inner edge of the flag;

sewing a triangular series of stitches in a corner of the corner patch adjacent to the hypotenuse of the corner patch and the twice rolled new exposed edge;

sewing eight diagonal series of stitches from the twice rolled new exposed edge at an angle to the inner edge of the flag; and sewing three series of stitches down the twice rolled new exposed edge, corner patch, and twill tape, wherein four of the eight diagonal series of stitches cross over the three series of stitches made down the twice rolled new exposed edge, corner patch, and twill tape that cross over the four series of stitches made along the inner edge that is covered by the corner patch and the twill tape.

20. The method as claimed in claim 16, wherein a series of stitches is sewn down a portion of any seam that reaches the new exposed edge.

* * * * *